US005209294A

United States Patent [19]

Weber

[11] Patent Number: 5,209,294

[45] Date of Patent: May 11, 1993

[54] ROTOR PLACER FOR PROGRESSIVE CAVITY PUMP

[76] Inventor: James L. Weber, P.O. Box 1089, North Battleford, Saskatchewan, Canada, S9A 3K2

[21] Appl. No.: 766,104

[22] Filed: Sep. 27, 1991

[30] Foreign Application Priority Data

Aug. 19, 1991 [CA] Canada ..... 2049502

[51] Int. Cl.[5] ..... E21B 23/00

[52] U.S. Cl. ..... 166/105; 418/48

[58] Field of Search ..... 166/369, 105; 418/48

[56] References Cited

U.S. PATENT DOCUMENTS 2,028,407 1/1936 Moineau .
2,456,227 12/1948 Wade .
2,527,673 10/1950 Byram .
3,802,803 4/1974 Bogdanov et al. ..... 418/48
3,879,094 4/1975 Tschirky et al. ..... 418/48
4,580,955 4/1986 Karge ..... 418/48
4,592,427 6/1986 Morgan ..... 166/369
4,636,151 6/1987 Eppink ..... 418/48
5,015,162 5/1991 Heppner ..... 418/48

*Primary Examiner*—Ramon S. Britts
*Assistant Examiner*—Frank S. Tsay

[57] ABSTRACT

A progressive cavity pump is used as part of the production string in an oil well. A pump stator is coupled to the production tubing string, while the rotor is driven by a sucker rod. To ensure proper placement of the rotor in the stator, the rotor is driven by a drive shaft with two universal joints with the upper end of the drive shaft held in position by a thrust bearing on the drive shaft and engaging a bearing seat connected to the production tubing. This ensures proper vertical placement of rotor in the stator. It also prevents eccentric motion of the upper end of the drive shaft, so that the sucker rod is no longer subject to whipping action that may damage the production tubing and the sucker rod string.

14 Claims, 2 Drawing Sheets

ROTOR PLACER FOR PROGRESSIVE CAVITY PUMP

FIELD OF THE INVENTION

The present invention relates to oil wells and more particularly to a stabilizer for use with a progressive cavity pump in a producing oil well.

BACKGROUND

A progressive cavity pump may be used as part of a production tubing string in an oil well. The pump consists of two parts, a stator and a rotor. The stator is connected into the production tubing that is lowered into the well casing and suspended in the well bore from the surface. The rotor is a helical element that rotates in a helical passage in the stator to drive oil through the stator. The rotor is suspended from and driven by a sucker rod string.

With this type of production string, the placement of the rotor in the stator is inexact. The torque loads on the sucker rod string vary dramatically during the pumping operation due to differences in gradients of fluids being pumped and the passage of solids through the pump. When the torque increases on the rod string, the consequent torsional deformation of the string produces a shortening of the string. Conversely, when torque on the string decreases, the string lengthens. This causes the rotor to move vertically up and down inside the stator. This detracts significantly from pump efficiency and leads to premature wear of the pump.

A complicating factor in dealing with rotor placement is the fact that the rotor not only rotates about its own axis but it also moves in a circular or eliptical path within the stator. This motion of the rotor may also cause the sucker rod string to whip violently within the production tubing, leading to premature wear of the production tubing and undesirable stresses on both the production tubing and the rod string. This effect may also cause the movement of the pump stator from side to side in the production casing, which is also undesirable.

SUMMARY

According to one aspect of the present invention there is provided, for use in an oil well having production tubing, a progressive cavity pump with a stator coupled to the production tubing and a rotor rotatable in the stator, and sucker rod means coupled to the rotor for rotating the rotor in the stator, a rotor placer comprising:

drive shaft means with a lower end for driving connection to the rotor and an upper end for driven connection to the sucker rod means;

bearing means connected to the drive shaft means at a fixed position therealong; and bearing seat means for connection to the production tubing at a fixed position therealong and engageable with the bearing means so as to limit movement of the bearing means along the production tubing towards the stator.

The rotor placer thus keeps the rotor in the correct position within the stator. It is preferred that a slip joint, for example a splined coupling is used in the sucker rod to allow expansion or contraction of the sucker rod without displacing the rotor.

Where rod whipping is a problem, the drive shaft may be flexible below the bearing, for example with two universal joints, and the bearing and seat may be constructed to hold the upper end of the drive shaft on a fixed axis in the production tubing. The drive shaft and its universal joints accommodate the eccentric motion of the rotor. This arrangement also stabilizes the top of the pump stator, so that it will not move from side to side or circularly within the production casing.

According to another aspect of the present invention there is provided an oil well with a production string incorporating a progressive cavity pump and a rotor placer.

The invention, in all of its aspects, is useful in a pump installation with any orientation. With other than a vertical installation, e.g. horizontal, the installation and operation are the same.

BRIEF DESCRIPTION OF THE DRAWINGS

In the accompanying drawings, which illustrate an exemplary embodiment of the present invention.

DETAILED DESCRIPTION

Figure 1:
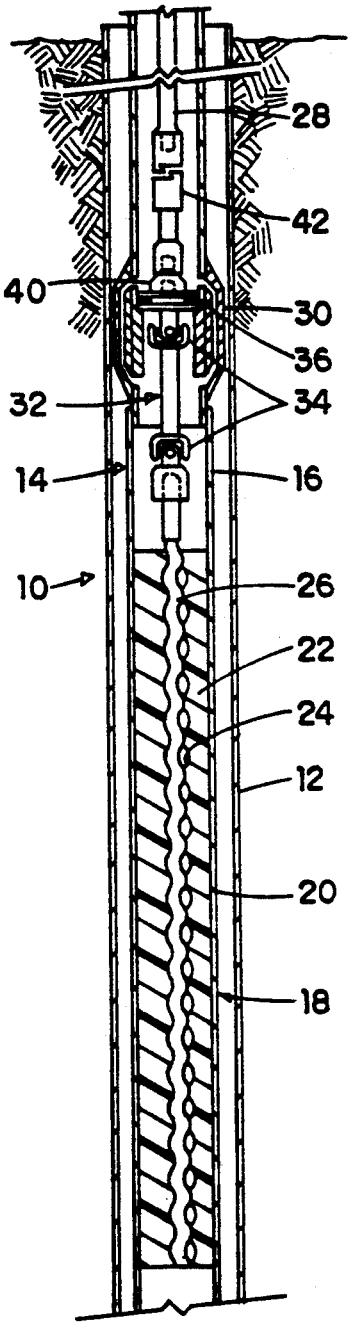
FIG. 1 is an elevation, in section, of an oil well incorporating the present invention.
Figure 2:
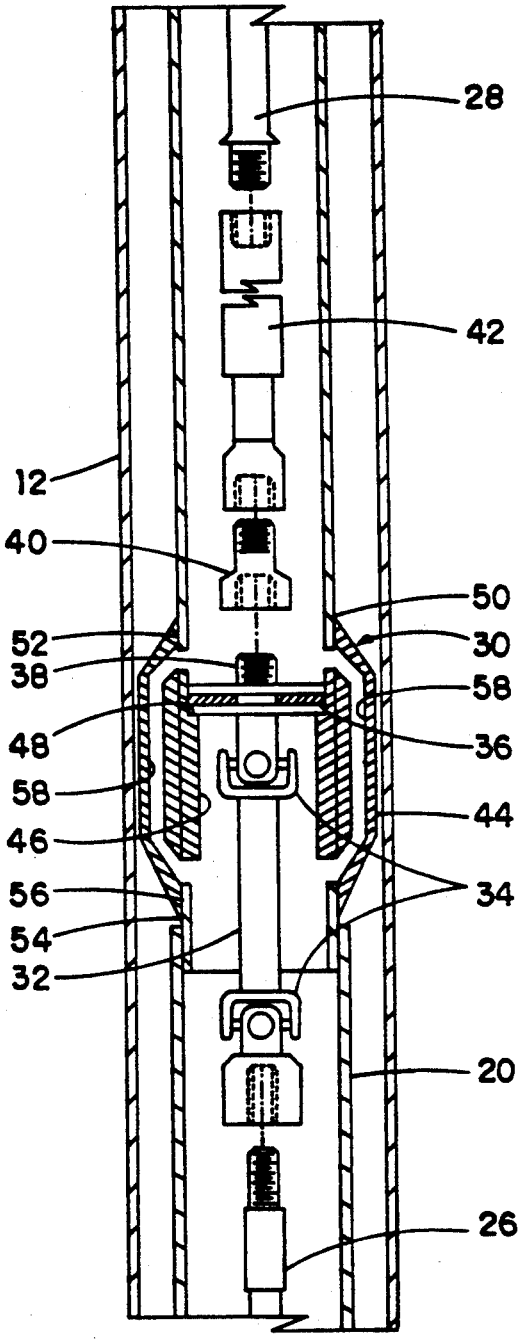
FIG. 2 is an enlarged, exploded view of a rotor placer according to the present invention.
Figure 3:
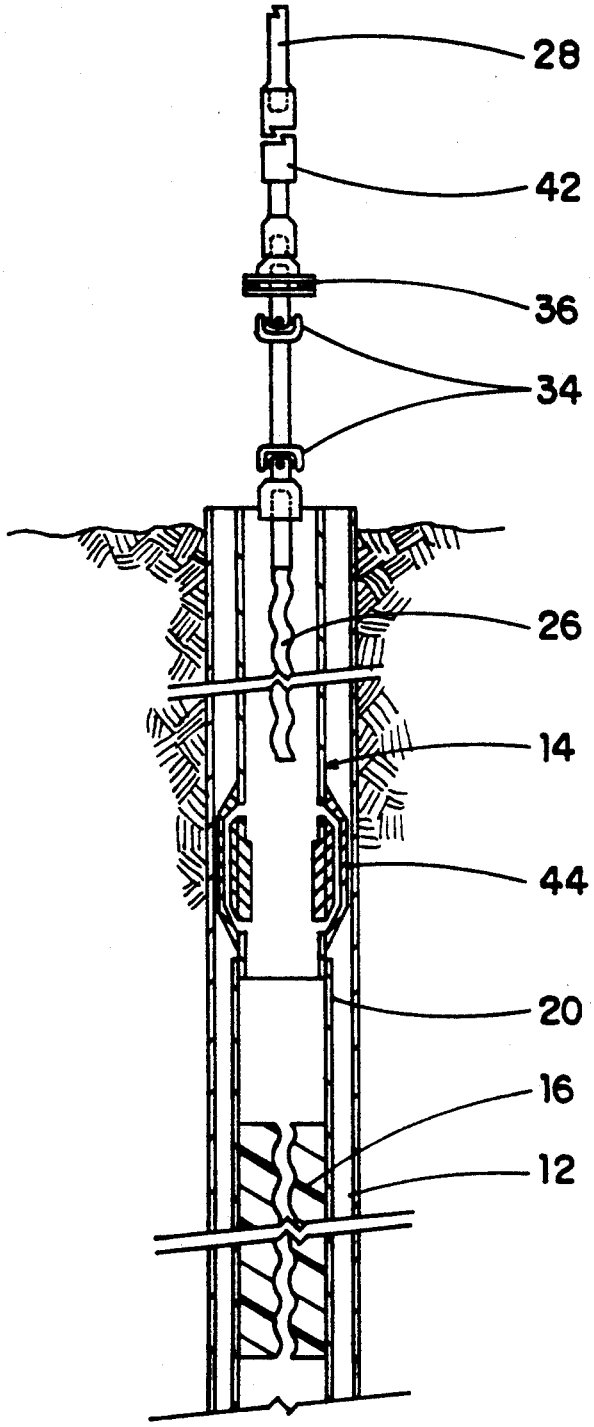
FIG. 3 is a view like FIG. 1 showing the lowering of the rotor and placer into the production tubing.

Referring to the accompanying drawings, and especially to FIGS. 1 and 3, there is illustrated an oil well 10 having a production casing 12 lining the well bore. Within the casing is a production tubing string 14 containing a progressive cavity pump 16. The pump has a stator 18 consisting of a steel barrel 20 connected to the production tubing and an elastomeric lining 22 with a helical through passage 24. The pump also includes a helical rotor 26 that runs in the passage 24. Pumps of this sort are known.

In use of a progressive cavity pump, the rotor rotates about its own axis and also revolves within the stator. The accurate placement of the rotor within the stator is of importance for full efficiency of the pump.

The rotor of the pump is driven by a sucker rod string 28 from the surface. The string operates through a rotor placer 30. The placer includes a flexible drive shaft 32 coupled at its lower end to the pump rotor 26. The shaft contains two universal joints 34 located below a thrust bearing 36. A coupling 38 on the upper end of the shaft, above the thrust bearing is connected to a sub 40 which is in turn coupled to a slip joint 42 forming part of the sucker rod string 28. The slip joint allows extension and contraction of the sucker rod string above the thrust bearing 36.

In the production tubing, between the stator barrel 20 and the next highest section of the tubing is a tubular housing 44. This has a central through passage 46 with an upwardly-facing shoulder 48 engaging the thrust bearing 36 to limit its movement towards the pump stator 18. The upper end 50 of the housing 44 is connected to the production tubing by an appropriate coupling 52, while the lower end 54 is connected to the stator barrel 20 by a coupling 56. A series of flow passages 58 are formed in the wall of the housing, leading from below the bearing seat 48 to above the bearing seat, thus allowing fluid pumped by the pump 16 to bypass the thrust bearing 36.

In use of the rotor placer, the engagement of the thrust bearing 36 with the bearing seat 48 provides a fixed positioning of the upper end of the drive shaft 32 along the production string. This in turn provides a fixed positioning of the rotor 26 within the production string and thus within the stator 18. The slip joint 42 accommodates any variations in the length of the sucker rod string that may occur.

The thrust bearing 36 is also constructed to fix the lateral positioning of the upper end of the drive shaft so that it rotates about a fixed axis within the production tubing. The universal joints in the drive shaft accommodate the eccentricity of the rotor within the stator so that whipping motions are not transmitted to the sucker rod string, essentially eliminating this source of premature wear and damage to the production tubing and the sucker rod string itself.

As illustrated most particularly in FIG. 3, the system is installed by inserting the housing 44 in the production tubing string, between the pump stator and the next highest section of the production tubing. After placing the production tubing string in the casing, rotor, the drive shaft and the thrust bearing are lowered into the production tubing using the sucker rod string. The rotor is screwed into the stator. The slip joint in the sucker rod string is constructed so that it will not come apart in order to allow the sucker rod string to suspend the other components in the well during installation. Once the bearing 36 is seated on the bearing seat 44, the rotor is properly placed within the stator.

While one embodiment of the present invention has been described in the foregoing, it is to be understood that other embodiments are possible within the scope of the invention. The invention is to be considered limited solely by the scope of the appended claims.

I claim:

1. A rotor placer for use in an oil well having production tubing, a progressive cavity pump with a stator coupled to the production tubing and a rotor rotatable in the stator, and sucker rod means coupled to the rotor for rotating the rotor in the stator, said rotor placer comprising:

drive shaft means with a lower end for driving connection with the rotor and an upper end for driven connection to the sucker rod means;

bearing means connected to the drive shaft at a fixed position therealong;

bearing seat means for connection to the production tubing at a fixed position therealong and engageable with the bearing means so as to limit movement of the bearing means along the production tubing towards the stator.

2. A rotor placer according to claim 1 wherein the sucker rod means comprise a sucker rod string, the string including slip joint means for allowing free elongation and contraction of the string.

3. A rotor placer according to claim 1 including fluid passage means for passing fluid from the production tubing below the bearing means to the production tubing above the bearing means.

4. A rotor placer according to claim 1 wherein the bearing seat means comprise a housing having opposite first and second ends with couplings thereon for connection to the production tubing, a bearing seat in the housing and fluid passages through the housing, past the bearing seat.

5. A rotor placer according to claim 1 wherein the drive shaft means comprise a flexible drive shaft and the bearing means and bearing seat comprise means for restraining the drive shaft adjacent the bearing means for rotation about a substantially fixed axis.

6. A rotor placer according to claim 5 wherein the drive shaft comprises a plurality of universal joints.

7. An oil well according to claim 1 wherein the bearing is a thrust bearing.

8. An oil well having production tubing, a progressive cavity pump including a stator coupled to the production tubing and a rotor rotatable in the stator, a sucker rod string for rotating the rotor in the stator for pumping oil through the production tubing, and a rotor placer, said rotor placer comprising:

a drive shaft connected between the sucker rod string and the rotor;

bearing means mounted on the drive shaft at a fixed position therealong; and above the rotor and engaged with the bearing means for preventing movement of the bearing means and the drive shaft towards the stator.

9. An oil well according to claim 8 wherein the sucker rod string includes slip joint means for accommodating elongation and contraction of the rod string.

10. An oil well according to claim 8 including fluid passage means extending from between the stator and the bearing means to above the bearing means for passing oil past the bearing means.

11. An oil well according to claim 8 including a tubular housing having opposite upper and lower ends, coupling means for connecting the upper and lower ends of the housing to the production tubing, the bearing seat means being formed within the housing.

12. An oil well according to claim 11 including fluid passages extending through the housing seat means to above the bearing seat means.

13. An oil well according to claim 8 wherein the drive shaft comprises a flexible drive shaft and the bearing means and the bearing seat means comprise means for restraining the drive shaft adjacent the bearing means to rotate about a substantially fixed axis with respect to the production tubing.

14. An oil well according to claim 13 wherein the drive shaft comprises a plurality of universal joints.

* * * * *